US005599223A

United States Patent [19]

Mains Jr.

[11] Patent Number: 5,599,223

[45] Date of Patent: *Feb. 4, 1997

[54] METHOD FOR MATERIAL REMOVAL

[76] Inventor: Gilbert L. Mains Jr., 2642 Joelle Dr., Toledo, Ohio 43617

[ * ] Notice: The term of this patent shall not extend beyond the expiration date of Pat. No. 5,222,332.

[21] Appl. No.: 265,430

[22] Filed: Jun. 24, 1994

Related U.S. Application Data

[63] Continuation-in-part of Ser. No. 986,379, Dec. 7, 1992, Pat. No. 5,341,608, which is a continuation of Ser. No. 684,979, Apr. 10, 1991, Pat. No. 5,222,332.

[51] Int. Cl.[6] ..... B24C 1/00

[52] U.S. Cl. ..... 451/39; 451/40; 451/53; 83/53; 83/177; 134/24

[58] Field of Search ..... 83/16, 53, 169, 83/177; 134/6, 7, 8, 24; 451/39, 40, 53

[56] References Cited

U.S. PATENT DOCUMENTS

| | | | |
|---|---|---|---|
| 2,985,050 | 5/1961 | Schwacha | 83/53 |
| 3,508,621 | 4/1970 | Gaylord et al. | 451/39 X |
| 3,676,963 | 7/1972 | Rice et al. | 451/39 |
| 3,712,306 | 1/1973 | Bryne | 606/22 |
| 3,746,256 | 7/1973 | Hall et al. | 239/101 |
| 3,900,975 | 8/1975 | Lightstone et al. | 451/53 |
| 3,979,981 | 9/1976 | Lightstone et al. | 83/15 |
| 4,262,567 | 4/1981 | Bettin | 83/171 |
| 4,389,820 | 6/1983 | Fong et al. | 451/75 |
| 4,447,952 | 5/1984 | Elkins | 30/361 |
| 4,508,577 | 4/1985 | Conn et al. | 134/24 X |
| 4,594,924 | 6/1986 | Windisch | 83/177 |
| 4,658,683 | 4/1987 | Phillips | 451/40 X |
| 4,686,877 | 8/1987 | Jaritz et al. | 83/177 |
| 4,693,153 | 9/1987 | Wainwright et al. | 83/53 |
| 4,723,387 | 2/1988 | Krasnoff | 451/75 |
| 4,806,171 | 2/1989 | Whitlock et al. | 134/7 |
| 4,829,859 | 5/1989 | Yankoff | 82/1.11 |
| 4,918,941 | 4/1990 | Hagler | 62/320 |
| 5,001,873 | 3/1991 | Rufin | 451/39 |
| 5,009,240 | 4/1991 | Levi | 134/7 |
| 5,018,667 | 5/1991 | Lloyd | 239/132.5 |
| 5,025,597 | 6/1991 | Tada et al. | 451/75 |
| 5,097,731 | 3/1992 | Vives et al. | 83/53 |
| 5,165,602 | 11/1992 | Arnout et al. | 239/8 |
| 5,222,332 | 6/1993 | Mains, Jr. | 451/39 |
| 5,341,608 | 8/1994 | Mains, Jr. | 451/39 |

FOREIGN PATENT DOCUMENTS

| | | |
|---|---|---|
| 2475425 | 8/1981 | France . |
| 2042399 | 9/1980 | United Kingdom . |

*Primary Examiner*—Rinaldi I. Rada
*Assistant Examiner*—Raymond D. Woods
*Attorney, Agent, or Firm*—Reising, Ethington, Barnard & Perry

[57] ABSTRACT

A method and apparatus that allows the removal of solid material from a workpiece utilizes a high velocity stream of ice which is caused to impinge on the workpiece. A working liquid, such as water, is supplied at high pressure to a discharge nozzle with an orifice for forming the needle-like stream. The water is cooled before it reaches the nozzle to a temperature below its freezing point so that at least some of the stream is transformed to ice. Optionally, the stream is cooled after it is emitted from the orifice by flowing an envelope of cryogenic gas around the emitted stream. The apparatus includes an inner conduit that carries the working liquid through a cutting tool where the liquid is at least partially solidified by an evaporator that utilizes a cryogenic fluid to cool the working liquid. In a second embodiment, the inner conduit can be moved longitudinally through the cutting tool from a position in which the orifice is proximate the cutting tool to a position in which the orifice is located remotely of the cutting tool. This allows the inner conduit to be indexed into the workpiece to make deep cuts without having to make a wide cut to accept the cutting tool.

12 Claims, 6 Drawing Sheets

METHOD FOR MATERIAL REMOVAL

CROSS REFERENCE TO RELATED APPLICATIONS

This application is a continuation-in-part of U.S. Ser. No. 07,986,379, filed Dec. 7, 1992, now U.S. Pat. No. 5,341,608, which is a continuation of U.S. Ser. No. 07/684,979, filed Apr. 10, 1991, now U.S. Pat. No. 5,222,332, issued Jun. 29, 1993.

FIELD OF THE INVENTION

This invention relates to a method and apparatus for removal of material from solid bodies; more particularly, it relates to material removal by the use of a high velocity jet formed from a liquid.

BACKGROUND OF THE INVENTION

There are many industrial operations which require processing of solid workpieces by material removal to cut, shape or clean the workpiece. It is already known, and commonly used in industry, to utilize high pressure, high velocity liquid jets for such material removal operations. These known methods and apparatus have achieved a high state of development but still leave much to be desired in respect to efficiency of material removal and residual effects on the workpiece and on the work site.

In the prior art, solid workpieces of hard material are cut by use of high velocity liquid jets which effect the cut by material removal in particulate form from the kerf. In some applications, an abrasive material is added to the jet stream to enhance the cutting action. Water and other liquids have been proposed for use in the formation of the jet stream. This cutting technique has been proposed for application to cutting of metal workpieces including exotic metals which are extremely hard. It has also been proposed for use in cutting composite materials, concrete and stone.

It has been a common practice to clean the surfaces by the use of sand blasting and the use of water blasting with entrained abrasive particles, for example in the removal of unwanted deposits on the exterior walls of buildings of brick and stone. This method of material removal typically leaves a very large amount of residue of the working fluid.

The prior art methods and apparatus for material removal as discussed above, are inefficient, produce a low rate of material removal and leave an unduly large amount of residue and waste at the work site. There is a need to overcome such disadvantages in a wide variety of industrial applications. A particular application, for example, is stone cutting in quarrying operations. In such operations, such as the mining of granite blocks, the cutting operation has to be performed in a relatively confined area wherein the cutting tool has to be manually supervised and controlled or sometimes manually manipulated. In such an operation, huge blocks of granite weighing many tons, for example, are cut in rectangular form from a monolith of great extent. It is desirable to sever the block with a narrow kerf and thereby minimize the amount of material removal required. It is also desirable to minimize the contamination of the air in the work area and to leave only a minimum amount of harmless residue.

The following patents relate to methods and apparatus for material removal by use of the high velocity jet stream of liquid or other material: U.S. Pat. Nos. 2,985,050 Schwacha, issued May 23, 1961; 3,746,256 Hall et al, issued Jul. 17, 1973; 4,594,924 Windisch, issued Jun. 17, 1986; 4,686,877 Jaritz et al, issued Aug. 18, 1987; 4,693,153 Wainwright et al, issued Sep. 15, 1987; and 4,723,387 Krasnoff, issued Feb. 9, 1988.

It is known in the prior art to use carbon dioxide in solid phase for use in cleaning a workpiece. In this prior art solid pellets of carbon dioxide are formed on the surface of a drum which is rotated at high speed to throw the pellets by centrifugal force against a workpiece for cleaning or other purposes.

The following patents relate to the use of cryogenic fluids in connection with cutting apparatus or methods. The Lightstone et al U.S. Pat. No. 3,979,981, issued Sep. 14, 1976 discloses a method for shearing metal in which the metal is cooled to a cryogenic temperature and using shearing operations such as slitting, punching, and blanking. The Lightstone et al U.S. Pat. No. 3,900,975, issued Aug. 26, 1975 discloses a process for abrasively grinding copper in which the copper workpiece is cooled to a cryogenic temperature. The Elkins U.S. Pat. No. 4,447,952, issued May 15, 1984 describes an underwater cutting or penetrating device which uses a source of liquid nitrogen for cooling a workpiece before impact by an explosively driven member. The Bryne U.S. Pat. No. 3,712,306, issued Jan. 23, 1973 discloses a cryosurgical instrument which has an open ended chamber pressed into contact with tissue. A stream of liquified nitrogen impinges directly on the tissue which is to be necrotized by freezing. The Bettin U.S. Pat. No. 4,262,567, issued Apr. 21, 1981 and the Hagler U.S. Pat. No. 4,918,941, issued Apr. 24, 1990 disclose the use of cryogenic fluids for cooling microtomes.

A general object of this invention is to provide an improved method and apparatus for material removal by a high velocity stream impinging on the workpiece and to overcome certain disadvantages of the prior art.

SUMMARY OF THE INVENTION

In accordance with this invention, method and apparatus are provided for material removal from a solid workpiece using a high velocity jet stream formed from a working liquid and containing solid particles but which leaves no solid residue. This is accomplished by producing a high speed jet stream containing needles or particles of ice.

In accordance with this invention, solid material is removed from a workpiece by supplying a pressurized working liquid to a discharge nozzle having an orifice for emitting a needle-like stream at high velocity. The working liquid is cooled before it reaches the nozzle to a temperature below its freezing point whereby at least some of the stream is in a solid phase state. The stream issuing from the orifice is caused to impinge on the workpiece to dislodge solid material therefrom. Optionally, the stream may be cooled after it is emitted from the orifice to maintain it below its freezing point between the orifice and the workpiece. Preferably, the pressurized working liquid is water which is cooled by a cryogenic fluid.

In accordance with another aspect of the invention, deep holes and cuts can be bored using an embodiment of the invention in which the working material flows through a conduit that can be indexed into the hole (or cut) in the workpiece. The conduit is part of a charge forming barrel that includes an evaporator that is thermally coupled to the conduit to remove heat from the working material flowing through the conduit. The conduit is normally maintained in a retracted position in which the orifice of the conduit is proximate the evaporator. This minimizes the length of the conduit extending between the exit point of the evaporator and the orifice and therefore aids in minimizing the temperature of the working material at the orifice.

Initially, the orifice is held near the surface of the workpiece as boring of the workpiece begins. Once a hole has been bored to a depth such that the cutting action is diminished, the conduit can be indexed through the evaporator and into the hole so as to bring the orifice near the bottom of the hole in the workpiece. In this way, deep cuts can be made without having to make a hole that is wide enough to accept the evaporator. In the event that the temperature of the working material emitted from the orifice rises as a result of the orifice being indexed into the hole and away from the evaporator, the conduit can be retracted until the orifice is again proximate the evaporator and then held there until the temperature of the working material lowers to the point that the stream includes a sufficient amount of solidified material to provide the desired cutting action. Thereafter, the conduit can be extended into the hole for further cutting.

A complete understanding of this invention will be obtained from the detailed description that follows taken with the accompanying drawings.

BEST MODE FOR CARRYING OUT THE INVENTION

Figure 1:
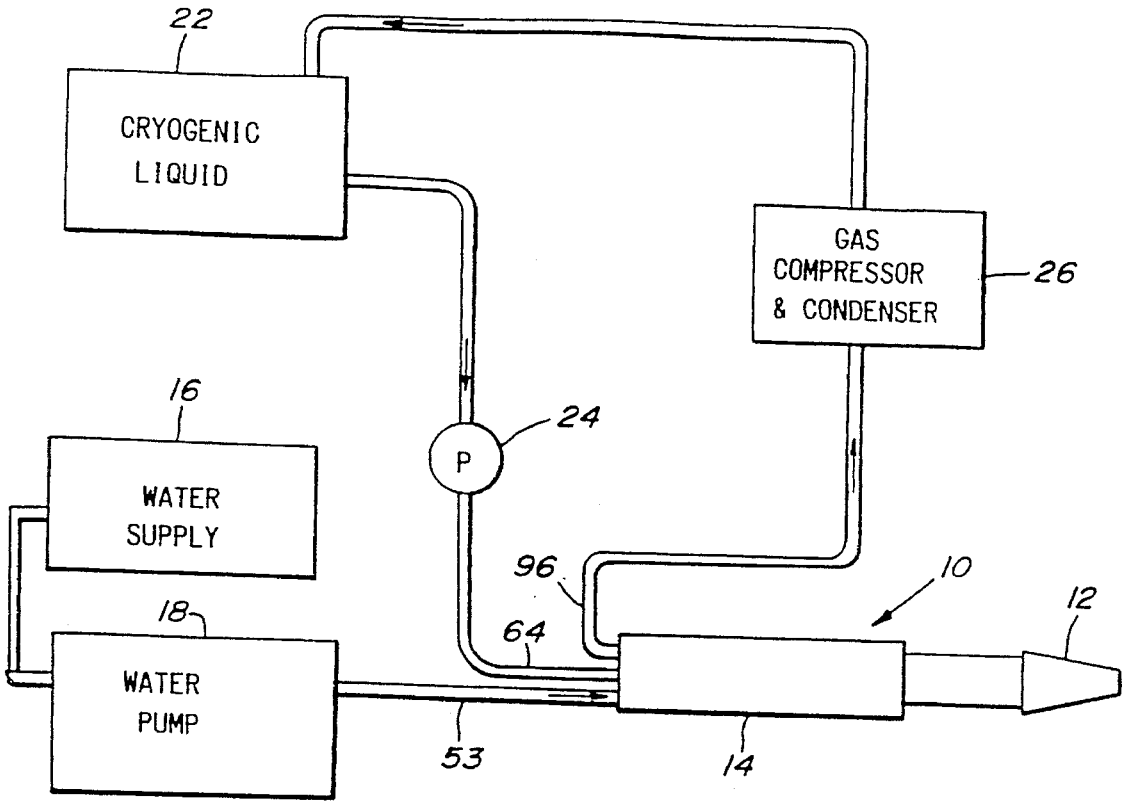
FIG. 1 is a diagram of a first embodiment of the invention.

Referring now to the drawings, there is shown illustrative embodiments of the invention in a material removing apparatus which is especially adapted for cutting of stone and concrete. It will be appreciated, as the description proceeds, that the invention may be embodied in different forms and may be utilized in a wide variety of applications.

A first embodiment of the material removing apparatus of this invention is illustrated in FIG. 1 in diagrammatical form. It comprises, in general, a cutting tool 10 including a nozzle 12 and a charge forming barrel 14. The cutting tool 10 is supplied with a working liquid, specifically water, from a water supply source 16 through a high pressure pump 18. For the purpose of freezing the water as it is emitted from the nozzle 12, the cryogenic liquid supply source 22 is connected through a pump 24 to the tool 10. For the purpose of conserving the cryogenic material, at least a portion of the cryogenic gas which flows through the charge forming barrel 14 is returned through a gas compressor and condenser 26 to the supply source 22.

The cutting tool 10 will be described in greater detail with reference to FIG. 3. The charge forming barrel 14 comprises an insulating cylindrical sleeve 32 of double wall construction. The inner and outer walls 34 and 35 are radially spaced and hermetically joined at the ends to form enclosed annular chamber 36 which is evacuated to provide thermal insulation. A rear end cap 38, suitably circular, is provided with an annular boss 42 which threadedly engages the cylindrical sleeve 32 and forms a gas-tight closure therewith. Similarly, a front end cap 44 is provided with an annular boss 46 which is threadedly engaged with the cylindrical sleeve 32 in gas-tight sealing engagement therewith. The front end cap 44 is provided with a unitary nozzle fitting 48 to receive the nozzle 12 which will be described subsequently.

The charge forming barrel 14 includes a centrally disposed water conduit 52 extending axially through the rear end cap 38, the cylindrical sleeve 32 and the nozzle fitting 48. The inlet end of the conduit 52 is connected by a water supply conduit 53 to the pump 18. The water conduit 52 has a section 54 of relatively small internal diameter and a section 56 of relatively large internal diameter, the sections being joined by an expansion throat 58. As will be described, water is flowed through the water conduit 52 at very high pressure from the pump 18. A flow regulating valve may be connected in the supply conduit 53 to permit adjustment of flow to a desired value.

The water in the conduit 52 is refrigerated by a flow of cryogenic fluid in the charge forming barrel 14 to transform the water from liquid phase to solid phase in the form of ice crystals as will be described. Refrigeration of the water in the conduit 52 is provided by a cryogenic fluid evaporator in heat exchange relation with the conduit in the charge forming barrel 14. The evaporator comprises an expansion chamber with a retroverted flow path for the cryogenic fluid. The flow path enters the charge forming barrel 14 through a passage 62 which is connected by a conduit 64 to the cryogenic liquid pump 24. The flow path for the cryogenic fluid is indicated by the dashed-line arrows 66. The path is defined by a pair of coaxial sleeves 72 and 74, the former being secured in the annular boss 42 of the rear end cap 38 and the latter being secured in the annular boss 46 of the front end cap 44. Thus, the gas is constrained to flow in an outer annular passage 76 between the insulating cylindrical sleeve 32 and the sleeve 72 in the forward direction and then in the reverse direction through an intermediate annular passage 78 between the sleeves 72 and 74. In a final pass, the cryogenic fluid flows in the inner annular passage 82 between the sleeve 74 and the water conduit 52. In order to supply the cryogenic fluid to the nozzle 12, the nozzle fitting 48 is provided with plural axial passages 84 extending from the passage 82 to the nozzle 12, which will be described subsequently.

For the purpose of conserving the cryogenic fluid which is not supplied to the nozzle 12, a return flow path, indicated by the interrupted line arrows 86, is provided in the charge forming barrel 14. This return flow path includes a passage 88 in the front end cap 44 which intersects one of the passages 84. It also includes a tube 92 extending from the passage 88 throughout the length of the barrel 14 to a passage 94 in the rear end cap 38. A conduit 96 connects the passage 94 in the rear end cap 38 to the gas compressor and condenser 26.

The nozzle 12 comprises an inner nozzle member 102 and a coaxial outer nozzle member 104. The inner nozzle member is mounted on the forward end of the water conduit 52 by a threaded connection. It is provided with a conical nose and an axially extending venturi passage 106 having a throat 108 of reduced diameter leading to an orifice 110 of somewhat larger diameter. An outer nozzle member 104 is provided with a tapered bore 114, somewhat conical in shape. The bore 114 has a minimum diameter at an orifice 112 and has a larger diameter at mouth 115. The bore 114 terminates at its rear end in a cylindrical threaded opening which is threadedly engaged with the nozzle fitting 48. An annular orifice plate 116 is disposed over the conical nose of the inner nozzle member 102 in conforming engagement therewith and has a conforming engagement at its outer periphery with the tapered wall of the bore 114 in the outer nozzle member 104. The orifice plate 116 is provided with a plurality, suitably six, orifices 118. An annular passage 122 is defined between the inner wall of the outer nozzle 104 and the outer wall of the inner nozzle 102 and extends from the axial passages 84 in the fitting 48 to the orifices 118 in the orifice plate 116 to provide for a regulated flow of cryogenic fluid therethrough.

Figure 2:
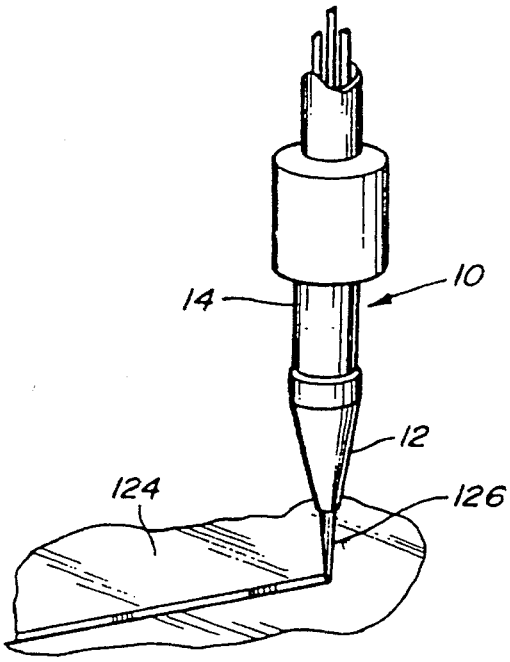
FIG. 2 shows the apparatus of FIG. 1 in relation to a workpiece.

In operation, as depicted in FIG. 2, the cutting tool 10 is adapted to remove material from a stone workpiece 124 by emitting a needle-like stream 126 of ice or particles of ice which impinges at high velocity against the workpiece. Water is delivered by the water pump 18 at very high pressure through the supply conduit 53 to the water conduit 52 of the charge forming barrel 14. There is a pressure drop and reduction in flow rate at the expansion throat 58 and through the conduit section 56 between the throat 58 and the inner nozzle 102. The cryogenic liquid from the source 22 is supplied by the pump 24 through the conduit 64 to the inlet passage 62 in the charge forming barrel 14. The annular passages 76, 78 and 82, which are of greatly increased cross-sectional area compared with the inlet passage 62, serve as an evaporator in which the cryogenic liquid vaporizes and flows through the annular passages in gaseous form. This produces a refrigerating effect on the water conduit 52 and the high pressure water stream therein is frozen into a column of ice. The stream of water under high pressure in the small diameter section 54 of the conduit 52 is in a supercooled state. In this section 54, the temperature is below the freezing point of water but the water therein remains in the liquid state due to the high pressure. At the expansion throat 58 the pressure on the water decreases and sufficient expansion is permitted to allow transformation to the solid state in the form of a column of ice. The column of ice is forced by the high pressure water behind it through the venturi passage 106 in the inner nozzle member 102 and is emitted therefrom. There is a needle-like stream moving at high velocity through the orifice 112 in the outer nozzle member 104. A portion of the cryogenic gas in the charge forming barrel 14, pressurized by the expansion therein, is forced through the passages 84 to the nozzle fitting 48 and into the annular passage 122 of the nozzle 12. The cryogenic gas flows through the orifices 118 in the orifice plate 116 and forms an envelope or sheath of cryogenic gas around the needle-like stream of ice which is projected at high velocity through the orifice 112. Thus, the gaseous sheath, which is below the freezing point of water, maintains the needle-like stream of ice in the solid state as it impinges upon the workpiece surface.

An example of a design of the cutting tool 10 is as follows. The tool is designed to use liquid nitrogen as the cryogenic liquid with water as the working liquid. The water pump 18 has the capacity to deliver water at 20,000 PSI through the supply conduit 53 at a flow rate of twelve gallons per minute to the inlet of the water conduit 52 on the charge forming barrel 14. The cryogenic liquid pump 24 has the capacity to deliver cryogenic liquid nitrogen through the conduit 64 at a pressure of 350 PSI to the inlet passage 62 in the charge forming barrel 14. Selected dimensions of the charge forming barrel and nozzle are as follows:

Charge forming barrel 14:
Length=20 ft.,
Diameter=2 in.;

Inlet passage 62:
Inside Diameter (I.D.)=3/16 in.;

Section 54 of water conduit 52:
Length=5 ft.,
I.D.=1/16 in.;

Section 56 of water conduit 52:
Length=15 ft.,
I.D.=1/8 in.

Nozzle fitting 48, six passages 84:
Diameter=1/16 in.

Orifice plate 116, six orifices 118:
Diameter=0.0052 in.;

Nozzle member 104:
Orifice 112, diameter=1/4 in.,
Mouth 115, diameter=3/16 in.;

Nozzle member 102:
Venturi throat 108, Diameter=0.052 in.,
Orifice 110, Diameter=0.062 in.

Figure 3:
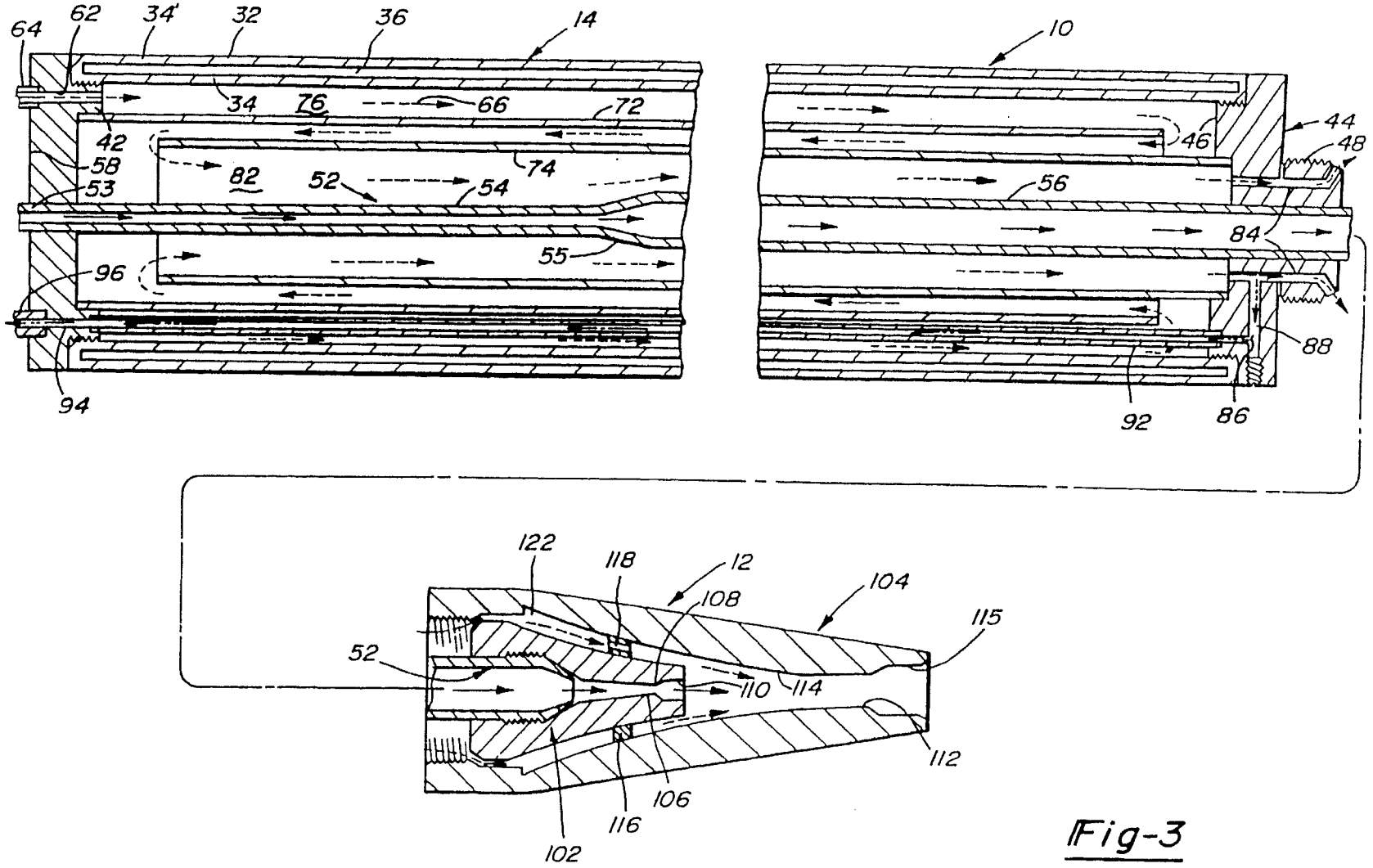
FIG. 3 shows certain details of construction of the apparatus of FIG. 1.

A second embodiment of the apparatus of the invention will now be described in connection with FIGS. 4–9, wherein elements in common with the embodiment of FIGS. 1–3 are denoted with like numerals and wherein modified elements of the embodiment of FIGS. 1–3 are denoted with primed numerals.

Figure 4:
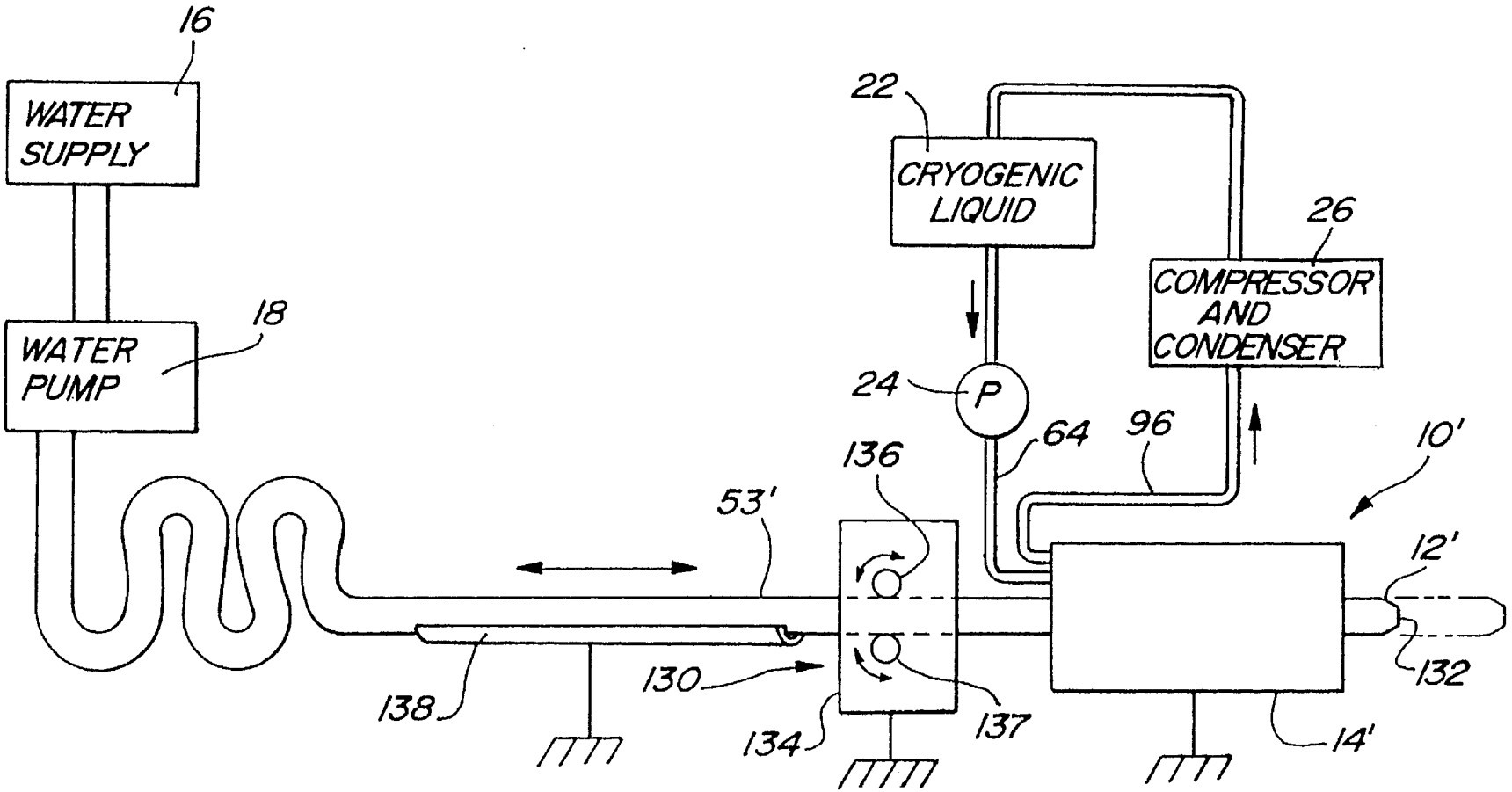
FIG. 4 is a diagram of a second embodiment of the invention.

As shown in FIG. 4, cutting tool 10' comprises a nozzle 12' and a charge forming barrel 14'. Cutting tool 10' is supplied with a liquid working material such as water via conduit 53'. The constructions and functions of water supply 16, high pressure pump 18, cryogenic liquid supply source 22, pump 24, and gas compressor and condenser 26 are the same described in connection with the first embodiment and the discussion will therefore not be repeated. The apparatus includes a pneumatically or hydraulically actuated drive 130 that indexes conduit 53' through charge forming barrel 14'. The conduit is shown in FIG. 4 in its retracted position in which orifice 132 of nozzle 12' is proximate charge forming barrel 14'.

Drive 130 is shown diagrammatically in FIG. 4 as a housing 134 and a pair of drive rollers 136 and 137 that are rotated together in opposite directions to either extend or retract conduit 53'. Various constructions of drive 130 will be apparent to those skilled in the art. Drive 130 can be operated to index conduit 53' for a limited distance from its retracted position to an extended position selectable by the user. Indexing of conduit 53' moves it through barrel 14' which is fixed in position with respect to drive 130. Indexing of conduit 53' also moves it along a track 138 that supports conduit 53'. An exemplary extended position of conduit 53' is indicated by broken lines in FIG. 4.

Figure 5:
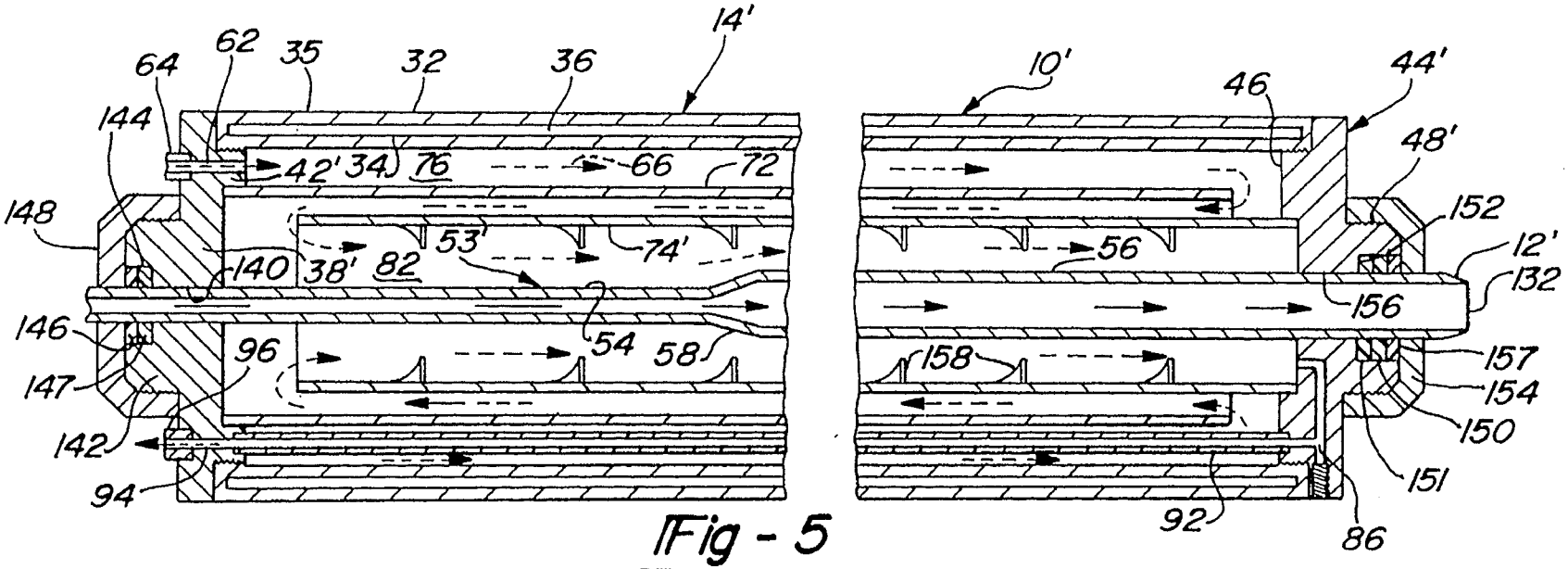
FIG. 5 shows greater detail of the cutting tool shown in FIG. 4.

Referring now to FIG. 5, cutting tool 10' has a construction similar to that of cutting tool 10, except that nozzles 102 and 104 have been eliminated and the ends of barrel 14' include seals to permit longitudinal movement of conduit 53' through barrel 14' without any loss of cryogenic fluid. In particular, nozzles 102 and 104 of FIG. 3 have been eliminated in this embodiment in order to minimize the diameter of nozzle 12'. This enables the diameter of the bored hole to be kept to a minimum to thereby reduce the amount of waste produced. This reduction of waste not only minimizes the amount of debris produced by the material removal operation, but is particularly useful in quarrying where it is desirable to maximize the yield from any particular block of stone. Moreover, by cutting less material, the operation can be performed faster and with less effort.

End cap 38' includes an aperture 140 through which conduit 53' extends. End cap 38' includes a threaded extension 142 that has a recess 144 that receives a pair of seals 146, 147. Seals 146 and 147 prevent loss of cryogenic fluid from passage 82 between aperture 140 and conduit 53'. Seals 146 and 147 can each be a V-ring packing or other suitable seal made from a composite material capable of providing a fluid-tight seal at the temperatures experienced at end cap 38' due to the presence of the cryogenic fluid within barrel 14'. A cap nut 148 is threaded over extension 142 to retain seals 146 and 147 within recess 144. End cap 44' has a similar construction, with seals 150 and 151 being retained within a recess 152 by a cap nut 154 to seal at aperture 156 of end cap 44'. End cap 44' includes a metal seal back-up ring 157, the construction and function of which will be described below .

If cutting tool 10' includes sections 54 and 56 of conduit 53', then the maximum distance by which conduit 53' can be indexed out through end cap 44' must be limited so as to prevent expansion throat 58 from exiting through aperture 156 in end cap 44'. Otherwise, the seal provided by seals 150 and 151 would be lost due to the smaller outer diameter of section 54 of conduit 53'.

If desired, sleeve 74' can include a plurality of fins 158 on its inner surface to swirl the cryogenic fluid as it moves through passage 82 to improve the cooling of the working material within conduit 53'. Fins 158 could be added to the inner surface of sleeve 74' by cutting sleeve 74' in half lengthwise, welding or otherwise attaching fins 158, and then welding the two halves of sleeve 74' back together.

Figure 6:
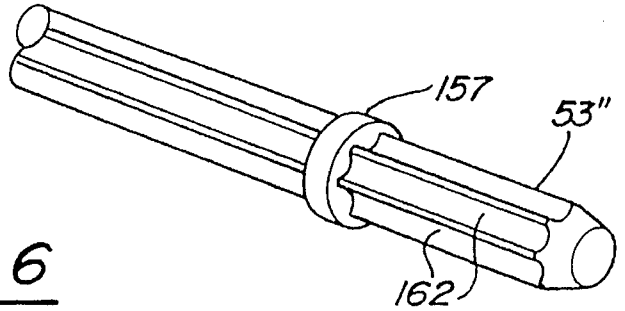
FIG. 6 is a perspective view of an indexable, fluted conduit and seal back-up ring that can be used with the second embodiment.
Figure 7:
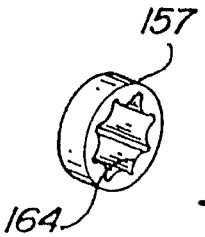
FIG. 7 is an end view of the seal back-up ring of FIG. 6.

To aid in the removal of waste material from the hole as it is being bored, conduit 53" shown in FIGS. 6 and 7 can be used in place of conduit 53'. Conduit 53" is fluted in its lengthwise direction, as indicated at 162. Also shown in FIG. 6 is seal back-up ring 157. Referring again briefly to FIG. 5, back-up ring 157 holds seals 150 and 151 in place. Flutes 162 end at expansion throat 58 so that no back-up ring is needed at end cap 38'. As shown in FIGS. 6 and 7, back-up ring 157 has an inner coutour 164 that conforms to the outer surface of conduit 53". This permits conduit 53" to be indexed through charge forming barrel 14' with little or no loss of cryogenic fluid through aperture 156. When conduit 53" is indexed into a hole being bored, waste material from the workpiece that is generated in the boring process can exit the hole by moving along the space defined by flutes 162 that exists between conduit 53" and the side wall of the hole. Other equivalent means for permitting the escape of dislodged pieces of the workpiece from the hole will be apparent to those skilled in the art. For example, inner conduit 53" could instead include a spiral wrap similar to that of an ordinary drill bit.

Referring now to FIGS. 8A–8D, a method of boring a hole 166 using the apparatus of FIGS. 4 and 5 will be described. Contrary to that shown in FIG. 4, cutting tool 10' is shown in FIGS. 8A–8D as being disposed in a vertical orientation, in which case drive 130 will be located above cutting tool 10' and an appropriate support structure would be used in place of support track 138 to hold and guide conduit 53' into drive 130. It will thus be appreciated that the apparatus of the invention can be used in whatever orientation is required for a particular application.

Figure 8A:
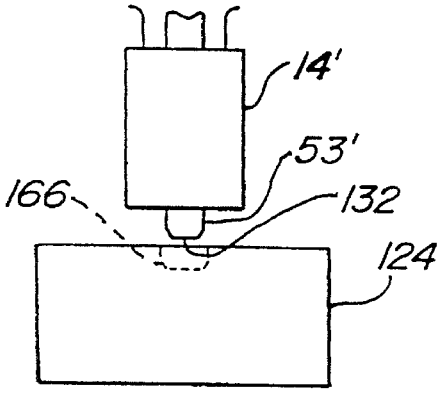
FIGS. 8A–8D together show a process for boring a hole using the apparatus of FIGS. 4 and 5.
Figure 8B:
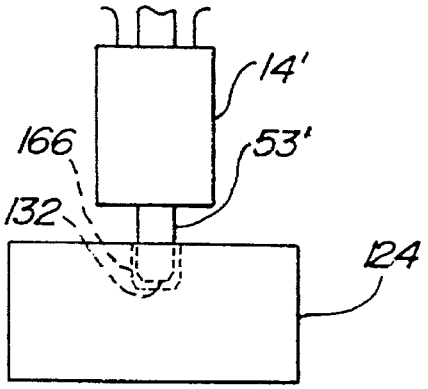
Figure 8C:
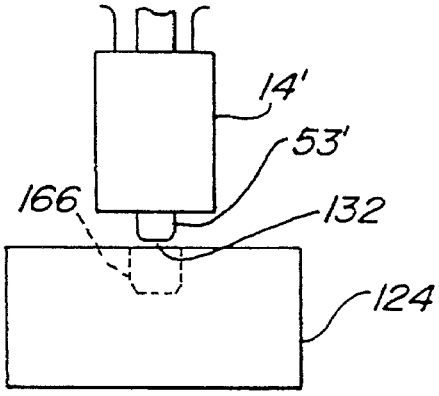
Figure 8D:
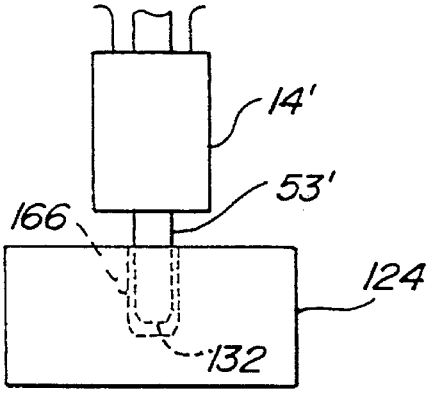

As shown in FIG. 8A, initially hole 166 is begun with conduit 53' being held in its retracted position in which orifice 132 is near the exit point of charge forming barrel 14'. As hole 166 is bored deeper, conduit 53' is then indexed into the hole to maintain orifice 132 near the surface of workpiece 124 from which the removal of material is desired (i.e., near the bottom of hole 166). This is shown in FIG. 8B. As will be appreciated by those skilled in the art, the boring operation shown in FIG. 8B can result in the temperature of conduit 53' proximate orifice 132 becoming heated due to such things as the heat generated by the removal of material from workpiece 124 and heating of conduit 53' due to friction from the waste material escaping hole 166 along the outer surface of conduit 53'. This in turn may result in the solid particles formed in conduit 53' within barrel 14' melting prior to impinging upon workpiece 124. Accordingly, the cutting action of cutting tool 10' will be reduced. When this happens, conduit 53' can be indexed back to its retracted position, as shown in FIG. 8C. Conduit 53' is then held in its retracted position until the nozzle end of conduit 53' is cooled sufficiently that it can be indexed back out from its retracted position without melting of the solid particles prior to their exit through orifice 132. Thereafter, conduit 53' can be reinserted into hole 166 to continue the boring operation, as shown in FIG. 8D. This process can be repeated as often as needed until hole 166 is bored to the desired depth.

As will be appreciated from the diagrammatic view provided by FIGS. 8A–8D, the indexing of conduit 53' into hole 166 enables workpiece 124 to be bored with only a minimal amount of waste being produced. As an example, a typical granite cutting operation uses compressed air and fuel to blast out holes in the granite that are used for the cutting of the slab. For a four by six foot slab of cut granite, four inches is typically lost due to this process. However, by using the indexable conduit method and apparatus of the invention, the holes can be cut with only a one inch loss of material.

Figure 9A:
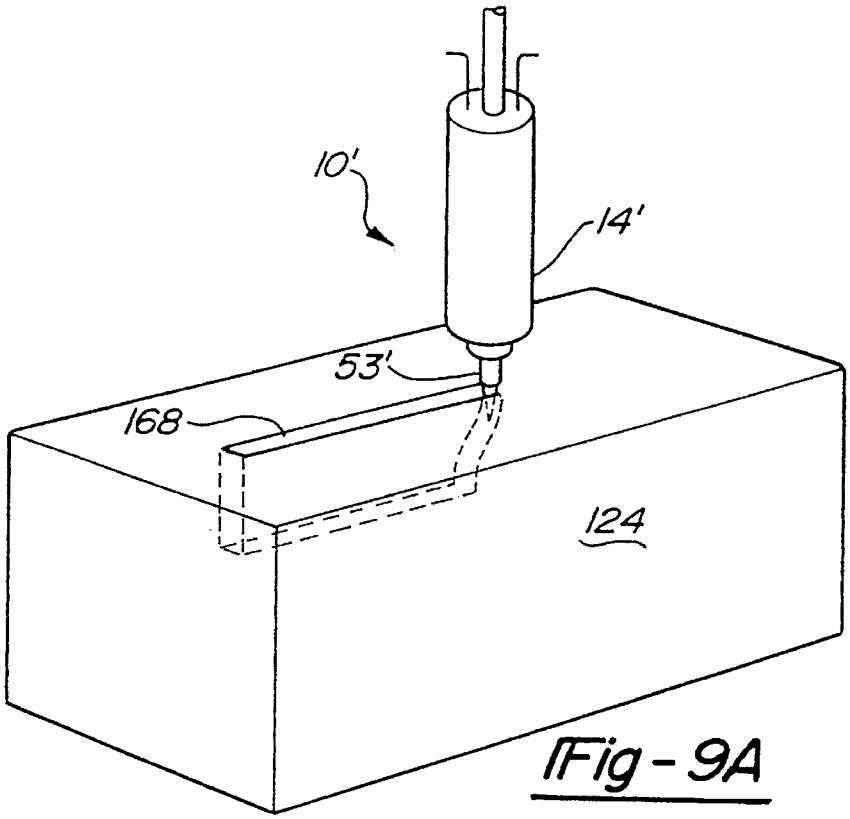
FIGS. 9A and 9B together show a process for boring a slot using the apparatus of FIGS. 4 and 5.
Figure 9B:
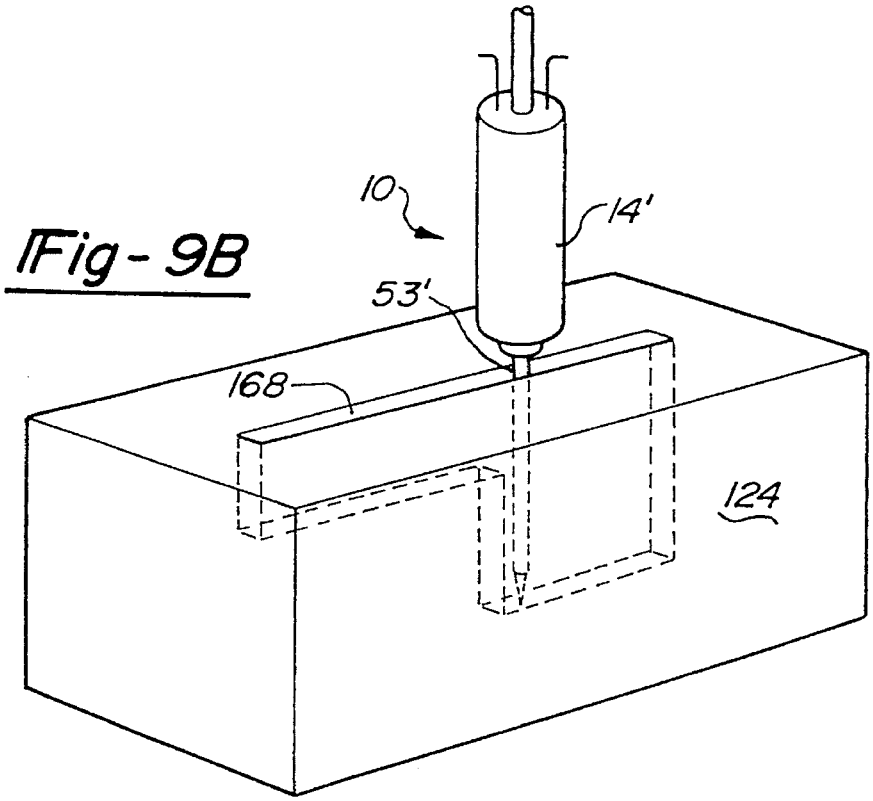

Referring now to FIGS. 9A and 9B, a method of cutting a slot 168 using the apparatus of FIGS. 4 and 5 will be described. Initially, conduit 53' is held in its retracted position while cutting tool 10' is moved along workpiece 124 to make a first cut, as shown in FIG. 9A. Thereafter, conduit 53' is indexed into slot 168 near the bottom of the slot and cutting tool 10' is again moved along workpiece 124 to make a second cut, as shown in FIG. 9B. This process can be repeated until the desired depth is reached for slot 168. As discussed in connection with FIG. 8C, conduit 53' can be indexed back to its retracted position as necessary to cool the nozzle end of conduit 53' to a temperature sufficient to prevent melting of all of the solid particles flowing within conduit 53' prior to their exit through orifice 132.

It will be understood that the cutting tools 10 and 10' of this invention may be used with working liquids other than water such as liquids having a suitably high freezing point or mixtures of water and other liquids or water with dissolved chemicals. Also, it will be understood that cryogenic fluids other than liquid nitrogen may be employed such as liquid carbon dioxide.

Although the description of this invention has been given with reference to a particular embodiment, it is not to be construed in a limiting sense. Many variations and modifications will now occur to those skilled in the art. For a definition of the invention reference is made to the appended claims.

What is claimed is:

1. A method of cutting a solid workpiece, comprising the steps of:

(a) forcing a stream of liquid working material through a conduit having an orifice for emitting the working material, (b) cooling a section of said conduit that extends through a heat exchanger having a cryogenic fluid in heat exchange relationship with said working material to thereby cause solidification of at least some of the working material emitted through said orifice, (c) impinging said working material on the workpiece to bore a hole that is dimensioned so as to accept said conduit therein, and (d) extending said conduit out of said heat exchanger and into the hole while maintaining said heat exchange relationship between said cryogenic fluid and said working material, and impinging said working material on the workpiece within the hole.

2. The method of claim 1, further comprising the steps of:

(e) retracting said conduit out of the hole and back into said heat exchanger, and (f) repeating steps (b) through (d).

3. The method of claim 2, further comprising the step of repeating steps (b) through (e) in succession until the hole has a desired depth.

4. The method of claim 1, wherein:

step (c) further comprises the step of moving said orifice along a path over a surface of the workpiece so as to bore the hole as a slot in the workpiece, and step (d) further comprises extending said conduit into the slot and moving said orifice along said path while impinging said working material on the workpiece within the slot.

5. The method of claim 1, further comprising the step of, prior to step (a), forming said conduit such that pieces dislodged from the workpiece that are within the hole can move along said conduit and out of the hole.

6. The method of claim 1, further comprising the step of cooling a section of said conduit remote from said orifice during step (d) to a temperature sufficient to cause solidification of at least some of said working material to thereby form solid particles that are emitted through said orifice.

7. The method of claim 1, further comprising the step of using liquid nitrogen as said cryogenic fluid.

8. The method of claim 1, further comprising the step of using liquid carbon dioxide as said cryogenic fluid.

9. The method of claim 1, further comprising the step of using water as said working material.

10. The method of claim 1, wherein said conduit comprises an inner conduit and wherein the method further comprises, prior to step (a), the steps of:

forming said heat exchanger using an outer conduit extending coaxially about said inner conduit so as to define a space between said inner and outer conduits, and flowing said cryogenic fluid through said space to thereby remove heat from said inner conduit.

11. The method of claim 1, further comprising the step of circulating at least a portion of said cryogenic fluid from a reservoir, through a pump, through said heat exchanger, through a condenser, and back to said reservoir.

12. The method of claim 11, further comprising the step of circulating said cryogenic fluid through said pump and then through said heat exchanger.

* * * * *